US008179032B2

(12) United States Patent
Eden et al.

(10) Patent No.: US 8,179,032 B2
(45) Date of Patent: May 15, 2012

(54) ELLIPSOIDAL MICROCAVITY PLASMA DEVICES AND POWDER BLASTING FORMATION

(75) Inventors: J. Gary Eden, Champaign, IL (US); Sung-Jin Park, Savoy, IL (US); Seung Hoon Sung, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 246 days.

(21) Appl. No.: 12/235,796

(22) Filed: Sep. 23, 2008

(65) Prior Publication Data

US 2010/0072893 A1 Mar. 25, 2010

(51) Int. Cl.
*H01J 1/00* (2006.01)
*H01J 1/88* (2006.01)

(52) U.S. Cl. ..... 313/493; 313/483; 313/484

(58) Field of Classification Search ..... 313/582, 313/581, 583–586, 483–512
See application file for complete search history.

(56) References Cited

U.S. PATENT DOCUMENTS

| | | | | |
|---|---|---|---|---|
| 3,755,027 | A * | 8/1973 | Gilsing | 156/67 |
| 3,908,147 | A | 9/1975 | Hall et al. | |
| 3,970,887 | A | 7/1976 | Smith et al. | |
| 4,808,883 | A | 2/1989 | Iwaya et al. | |
| 5,200,973 | A | 4/1993 | Ford | |
| 5,574,327 | A | 11/1996 | Cammack et al. | 313/110 |
| 6,016,027 | A | 1/2000 | DeTemple et al. | |
| 6,139,384 | A | 10/2000 | DeTemple et al. | |
| 6,194,833 | B1 | 2/2001 | DeTemple et al. | |
| 6,437,507 | B2 * | 8/2002 | Ha | 313/587 |

(Continued)

FOREIGN PATENT DOCUMENTS

JP 2003109523 A 4/2003

(Continued)

OTHER PUBLICATIONS

Park et al. (S.J. Park, C.J. Wagner, and J.G. Eden, "Performance of Microdischarge Devices and Arrays with Screen Electrodes", IEEE Photonics Technology Letters, vol. 13, No. 1, pp. 61-63, Jan. 2001).*

(Continued)

*Primary Examiner* — Minh Toan Ton
*Assistant Examiner* — Nathaniel Lee
(74) *Attorney, Agent, or Firm* — Greer, Burns & Crain Ltd.

(57) ABSTRACT

The invention provides microcavity plasma devices and arrays that are formed in layers that also seal the plasma medium, i.e., gas(es) and/or vapors. No separate packaging layers are required and additional packaging can be omitted if it is desirable to do so. A preferred microcavity plasma device includes first and second thin layers that are joined together. A half ellipsoid microcavity or plurality of half ellipsoid microcavities is defined in one or both of the first and second thin layers, and electrodes are arranged with respect to the microcavity to excite a plasma within said microcavities upon application of a predetermined voltage to the electrodes. A method for forming a microcavity plasma device having a plurality of half or full ellipsoid microcavities in one or both of first and second thin layers is also provided by a preferred embodiment. The method includes defining a pattern of protective polymer on the first thin layer. Powder blasting forms half ellipsoid microcavities in the first thin layer. The second thin layer is joined to the first layer. The patterning can be conducted lithographically or can be conduced with a simple screen.

41 Claims, 16 Drawing Sheets

U.S. PATENT DOCUMENTS

| | | | | |
|---|---|---|---|---|
| 6,456,007 | B1 | 9/2002 | Ryu et al. | |
| 6,541,915 | B2 | 4/2003 | Eden et al. | |
| 6,563,257 | B2 | 5/2003 | Vojak et al. | |
| 6,657,370 | B1 | 12/2003 | Geusic | |
| 6,695,664 | B2 | 2/2004 | Eden et al. | |
| 6,815,891 | B2 | 11/2004 | Cliff et al. | |
| 6,828,730 | B2 | 12/2004 | Eden et al. | |
| 6,867,548 | B2 | 3/2005 | Eden et al. | |
| 7,112,918 | B2 | 9/2006 | Eden et al. | |
| 7,126,266 | B2 | 10/2006 | Park et al. | |
| 7,195,733 | B2 | 3/2007 | Rogers et al. | |
| 2002/0113553 | A1 | 8/2002 | Vojak et al. | |
| 2003/0080664 | A1 | 5/2003 | Eden et al. | |
| 2003/0080688 | A1 | 5/2003 | Eden et al. | |
| 2003/0132693 | A1 | 7/2003 | Eden et al. | |
| 2003/0164684 | A1* | 9/2003 | Green et al. | 313/582 |
| 2003/0230983 | A1 | 12/2003 | Vonallmen | |
| 2004/0100194 | A1 | 5/2004 | Eden et al. | |
| 2004/0134778 | A1 | 7/2004 | Stelzle et al. | |
| 2004/0160162 | A1 | 8/2004 | Eden et al. | |
| 2005/0148270 | A1 | 7/2005 | Eden et al. | |
| 2005/0191783 | A1* | 9/2005 | Toyoda et al. | 438/34 |
| 2005/0195393 | A1 | 9/2005 | Karanassios | |
| 2005/0269953 | A1 | 12/2005 | Eden et al. | |
| 2006/0012297 | A1 | 1/2006 | Lee et al. | |
| 2006/0038490 | A1 | 2/2006 | Eden et al. | |
| 2006/0071598 | A1 | 4/2006 | Eden et al. | |
| 2006/0082319 | A1 | 4/2006 | Eden et al. | |
| 2006/0084262 | A1 | 4/2006 | Qin | |
| 2006/0284558 | A1 | 12/2006 | Kwon et al. | |
| 2007/0108906 | A1 | 5/2007 | Kang et al. | |
| 2007/0108910 | A1 | 5/2007 | Eden et al. | |
| 2007/0114936 | A1 | 5/2007 | Park et al. | |
| 2007/0170866 | A1 | 7/2007 | Eden et al. | |
| 2007/0200499 | A1 | 8/2007 | Eden et al. | |
| 2007/0236146 | A1 | 10/2007 | Kang et al. | |
| 2008/0003142 | A1 | 1/2008 | Link et al. | |
| 2008/0129185 | A1 | 6/2008 | Eden et al. | |
| 2008/0290799 | A1 | 11/2008 | Eden et al. | |
| 2010/0001629 | A1 | 1/2010 | Eden et al. | |

FOREIGN PATENT DOCUMENTS

| | | | |
|---|---|---|---|
| KR | 2003-0045540 | | 6/2003 |
| KR | 10-2005-0113533 | | 2/2005 |
| WO | WO 2007/011865 | | 1/2007 |
| WO | WO 2007/011865 | A2 | 1/2007 |
| WO | WO 2007/087285 | A2 | 8/2007 |
| WO | WO 2007/087371 | A2 | 8/2007 |
| WO | WO 2008/013820 | A2 | 1/2008 |

OTHER PUBLICATIONS

Park et al. (S.J. Park, C.J. Wagner, and J.G. Eden, "Performance of Microdischarge Devices and Arraus with SCreen Electrodes", IEEE Photonics Technology Letters, vol. 13, No. 1, pp. 61-63, Jan. 2001).

Sung-Jin Part, et al., "Microdischarge Arrays: A New Family of Photonic Devices," *IEEE Journal on Selected Topics in Quantum Electronics*, vol. 8, No. 1, Jan./Feb. 2002, pp. 139-147.

P. von Allmen, et al., "Ceramic microdischarge arrays with individually ballasted pixels," *Applied Physics Letters*, vol. 82, No. 16, Apr. 21, 2003, pp. 2562-2564.

B. A. Vojak, et al., "Multistate, monolithic ceramic microdischarge device having an active length of ~0.27 mm," *Applied Physics letters*, vol. 78, No. 10, Mar. 5, 2001, pp. 1340-1342.

J. G. Eden, et al., "Arrays of nonequilibrium plasmas confined to microcavities: an emerging frontier in plasma science and its applications,"*Institute of Physics Publishing*, Plasma Sources Sci. Technol. vol. 15, Apr. 26, 2006, pp. S67-S73.

J. G. Eden, et al., "Microplasma devices fabricated in silicon, ceramic, and metal/polymer structures: arrays, emitters and photodetectors," *Institute of Physics Publishing*, J. Phys. D: Appl. Phys. vol. 36, Nov. 19, 2003, pp. 2869-2877.

S. -J. Park, et al., "Integration of carbon nanotubes with microplasma device cathodes: reduction in operating and ignition voltages," *Electronics Letters*, vol. 40, No. 9, Apr. 29, 2004.

S.-J. Park, et al., "Flexible microdischarge arrays: Metal/polymer devices," *Applied Physics Letters*, vol. 77, No. 2, Jul. 10, 2000, pp. 199-201.

S.-J. Park, et al., "Performance of Microdischarge Devices and Arrays with Screen electrodes," *IEEE Photonics Technology Letters*, vol. 13, No. 1, Jan. 2001, pp. 61-63.

S.-J. Park, et al., "Independently addressable subarrays of silicon microdischarge devices: Electrical characteristics of large (30×30) arrays and excitation of a phosphor,"*Applied Physics Letters*, vol. 79, No. 13, Sep. 24, 2001, pp. 2100-2102.

S.-J. Park, et al., "Carbon nanotube-enhanced performance of microplasma devices," *Applied Physics letters*, Nov. 1984, No. 22, May 31, 2004, pp. 4481-4483.

S.-J. Park, et al., "Silicon microdischarge devices having inverted pyramidal cathodes: Fabrication and performace of arrays," *Applied Physics Letters*, vol. 78, No. 4, Jan. 22, 2001, pp. 419-421.

S.-J. Park, et al., "Stable Microplasmas in Air Gererated With a Silicon, Inverted Pyramid Plasma Cathode," *IEEE Transactions on Plasma Science*, vol. 33, No. 2, Apr. 2, 2005, pp. 570-571.

S.-J. Park, et al., "40 000 pixel arrays of ac-excited silicon microcavity plasma devices,"*Applied Physics Letters*, vol. 86, Mar. 8, 2005, pp. 111501-111503.

L.D. Biborosch et al., "Microdischarges with plane cathodes", *Applied Physics Letters*, vol. 75, No. 25, Dec. 20, 1999, pp. 3927-3928.

J. G. Eden, et al., "Microplasma Devices Fabricated in Silicon, Ceramic, and Metal/Polymer Structures: Arrays, Emitters and Photodetectors", *Journal of Physics D: Applied Physics*, vol. 36, 2003, pp. 2869-2877.

Ahmed El-Habachi et al., "Emission of excimer radiation from direct current, high-pressure hollow cathode discharges", *Appl. Phys. Lett.*, vol. 72, No. 1, Jan. 5, 1998, pp. 22-24.

Ahmed El-Habachi et al., "Series operation of direct current xenon chloride excimer sources", *Journal of Applied Physics*, vol. 88, No. 6, Sep. 15, 2000, pp. 3220-3224.

O. Jessensky et al., "Self-organized formation of hexagonal pore arrays in anodic alumina", *Applied Physics Letters*, vol. 72. No. 10, Mar. 9, 1998, pp. 1173-1175.

S. Kim, J.G. Eden, "Arrays of Microplasma Devices Fabricated in Photodefinable Glass and Excited AC or DC by Interdigitated Electrodes", *IEEE Photonics Technology Letters*, vol. 17, No. 7, Jul. 2005, pp. 1543-1545.

Mark J. Kushner, "Modeling of Microdischarge devices: Pyramidal structures", *Journal of Applied Physics*, vol. 95, No. 3, Feb. 1, 2004, pp. 846-859.

H. Masuda, K. Fukuda, "Ordered Metal Nanohole Arrays Made by a Two-Step Replication of Honeycomb Structures of Anodic Alumina", *Science*, vol. 268, No. 5216, Jun. 9, 1995, pp. 1466-1468.

Abdel-Aleam H. Mohammed et al., "Direct current glow discharges in atmospheric air", *IEEE Transactions on Plasma Science*, vol. 30, No. 1, Feb. 2002, pp. 182-183.

S.J. Park, C.J. Wagner, C.M. Herring, J.G. Eden, "Flexible Microdischarge Arrays: Metal/Polymer Devices", *Applied Physics Letters*, vol. 77, No. 7, Jul. 10, 2000, pp. 199-201.

S.J. Park, K.F. Chen, N.P. Ostrom, J.G. Eden, "40 000 Pixel Arrays Of Ac-Excited Silicon Microcavity Plasma Devices", *Applied Physics Letters*, vol. 86, 2005, pp. 111501-1-1-11501-3.

S.J. Park et al, "Independently addressable subarrays of silicon microdischarge devices: electrical characteristics of large (30 × 30) arrays microdischarge excitation of a phosphor", *Applied Physics Letters*, vol. 79, No. 13, Sep. 24, 2001, pp. 2100-2102.

S.J Park et al., "Arrays of microdischarge devices having 50-100 μm square pyramidal Si anodes and screen cathodes", *Electronics Letters*, vol. 37, No. 3, Feb. 1, 2001, pp. 171-172.

S.J. Park et al., "Carbon nanotube-enhanced performance of microplasma devices", *Applied Physics Letters*, vol. 84, No. 22, May 31, 2004, pp. 4481-4483.

S.J. Park et al., "Silicon microdischarge devices having inverted pyramidal cathodes: fabrication and performance of arrays", *Applied Physics Letters*, vol. 78, No. 4, Jan. 22, 2001, pp. 419-421.

K.H. Schoenbach et al, "High-pressure hollow cathode discharges", *Plasma Sources Sci. Technol.*, vol. 6, 1997, pp. 468-477.

Robert H. Stark et al, "Direct current high-pressure glow discharges", *Journal of Applied Physics* vol. 85, No. 4, Feb. 15, 1999, pp. 171-172.
Robert H. Stark et al, "Direct current glow discharges in atmospheric air", *Applied Physics Letters*, vol. 74, No. 25, Jun. 21, 1999, pp. 3370-3372.
K. Tachibana et al., "Characteristics of Ne-Xe Microplasma in Unit Discharge Cell of Plasma Display Panel Equipped with Counter Sustain Electrodes and Auxiliary Electrodes", *Journal of Physics D: Applied Physics*, vol. 38, 2005, pp. 1739-1749.
B.A. Vojak et al, "Multistage, monolithic ceramic microdischarge device having an active length of ~0.27 mm", *Applied Physics Letters*, vol. 78, No. 10, Mar. 5, 2001, pp. 1340-1342.
P. von Allmen et al., "Ceramic Microdischarge A rrays with Individually Ballasted Pixels", *Applied Physics Letters*, vol. 82, No. 16, Apr. 21, 2003, pp. 2562-2564.
C.J. Wagner, "Excitation of a microdischarge with a reverse-biased pn junction", *Applied Physics Letters*, vol. 78, No. 6, Feb. 5, 2001, pp. 709-711.
A.D. White "New Hollow Cathode Glow Discharge", *Journal of Applied Physics*, vol. 30, No. 5, May 1959, pp. 711-719.

* cited by examiner

Transparent or Nontransparent Conductor

ELLIPSOIDAL MICROCAVITY PLASMA DEVICES AND POWDER BLASTING FORMATION

STATEMENT OF GOVERNMENT INTEREST

This invention was made with Government assistance under U.S. Air Force Office of Scientific Research grant Nos. F49620-03-1-0391 and AF FA9550-07-1-0003. The Government has certain rights in this invention.

FIELD OF THE INVENTION

The invention is in the field of microcavity plasma devices, also known as microdischarge devices or microplasma devices.

BACKGROUND

Microcavity plasma devices produce a nonequilibrium, low temperature plasma within, and essentially confined to, a cavity having a characteristic dimension d below approximately 500 μm. This new class of plasma devices exhibits several properties that differ substantially from those of conventional, macroscopic plasma sources. Because of their small physical dimensions, microcavity plasmas normally operate at gas (or vapor) pressures considerably higher than those accessible to macroscopic devices. For example, microplasma devices with a cylindrical microcavity having a diameter of 200-300 μm (or less) are capable of operation at rare gas (as well as $N_2$ and other gases tested to date) pressures up to and beyond one atmosphere.

Such high pressure operation is advantageous. An example advantage is that, at these higher pressures, plasma chemistry favors the formation of several families of electronically-excited molecules, including the rare gas dimers ($Xe_2$, $Kr_2$, $Ar_2$, . . . ) and the rare gas-halides (such as XeCl, ArF, and $Kr_2F$) that are known to be efficient emitters of ultraviolet (UV), vacuum ultraviolet (VUV), and visible radiation. This characteristic, in combination with the ability of microplasma devices to operate in a wide range of gases or vapors (and combinations thereof), offers emission wavelengths extending over a broad spectral range. Furthermore, operation of the plasma in the vicinity of atmospheric pressure minimizes the pressure differential across the packaging material when a microplasma device or array is sealed.

Research by the present inventors and colleagues at the University of Illinois has resulted in news microcavity plasma device structures as well as applications. As an example, semiconductor fabrication processes have been adapted to produce large arrays of microplasma devices in silicon wafers with the microcavities having the form of an inverted pyramid. Arrays with 250,000 devices, each device having an emitting aperture of 50×50 $\mu m^2$, have been demonstrated with a device packing density and array filling factor of $10^4$ $cm^{-2}$ and 25%, respectively. Other microplasma devices have been fabricated in ceramic multilayer structures, photodefinable glass, and $Al/Al_2O_3$ structures.

Microcavity plasma devices developed over the past decade have a wide variety of applications. An exemplary application for a microcavity plasma device array is to a display. Since the diameter of single cylindrical microcavity plasma devices, for example, is typically less than 200-300 μm, devices or groups of devices offer a spatial resolution that is desirable for a pixel in a display. In addition, the efficiency of a microcavity plasma device can exceed that characteristic of conventional plasma display panels, such as those in high definition televisions.

Early microcavity plasma devices exhibited short lifetimes because of exposure of the electrodes to the plasma and the ensuing damage caused by sputtering. Polycrystalline silicon and tungsten electrodes extend lifetime but are more costly materials and difficult to fabricate.

Large-scale manufacturing of microcavity plasma device arrays benefits from structures and fabrication methods that reduce cost and increase reliability. Previous work conducted by some of the present inventors has resulted in thin, inexpensive metal/metal oxide arrays of microcavity plasma devices. Metal/metal oxide lamps are formed from thin sheets of oxidized electrodes, are simple to manufacture and can be conveniently fabricated by mass production techniques such as roll-to-roll processing. In some manufacturing techniques, the arrays are formed by oxidizing a metal screen, or other thin metal sheet having cavities formed in it, and then joining the screen to a common electrode. The metal/metal oxide lamps are light, thin, and can be flexible.

SUMMARY OF THE INVENTION

The invention provides ellipsoidal microcavity plasma devices and arrays that are formed in layers that also seal the plasma medium, i.e., gas(es) and/or vapors. No separate packaging layers are required and, therefore, additional packaging can be omitted if it is desirable to do so. A preferred microcavity plasma device includes first and second thin layers that are joined together. A half ellipsoid microcavity or plurality of half ellipsoid microcavities is present in one or both of the first and second thin layers and electrodes are arranged with respect to the microcavity to excite a plasma within the microcavities upon application of a predetermined voltage to the electrodes. In preferred embodiments, the ellipsoidal microcavities are formed in glass. In other embodiments, the ellipsoidal microcavities are formed in other materials that are transparent to a wavelength of interest, including many types of ceramics and polymers.

A method for forming a microcavity plasma device having a plurality of half or fill ellipsoid microcavities in one or both of the first and second thin layers is also provided by a preferred embodiment. The method includes defining a pattern of protective polymer on the first thin layer. Powder blasting forms half ellipsoid microcavities in the first and/or second thin layers. The second thin layer is joined to the first layer. The patterning can be conducted lithographically or can be conduced with a simple screen.

DETAILED DESCRIPTION OF THE PREFERRED EMBODIMENTS

The invention provides microcavity plasma devices and arrays having ellipsoidal microcavities fabricated in glass or other materials, such as ceramic or polymer materials, that are transparent at the wavelength(s) of interest. Devices and arrays of the invention are extremely robust and inexpensive to fabricate. Microcavities are formed in thin layers, which are transparent and can be flexible. As the microcavities are formed directly in transparent material and preferred arrays are completed upon a hard sealing of the two transparent sheets, no further packaging of the array is necessary. The packaging layer that seals vapor(s) and/or gas(es) into the microcavities is realized by the same sheet that serves as the substrate in which the microcavities are formed.

The invention also provides powder blasting methods of manufacturing microcavity plasma devices and arrays of microcavity plasma devices. Microcavities having an ellipsoidal ("egg shell" or "half egg shell") geometry are produced in thin sheets of glass, ceramics or polymers by an inexpensive nanopowder blasting technique that allows for considerable control over the cavity cross-section. Methods of the invention can produce large arrays of microplasma devices that substantially consist of a pair of thin glass, ceramic or polymer sheets.

A preferred microcavity plasma device includes first and second thin layers that are joined together. A half ellipsoid or full ellipsoidal microcavity (or plurality of half ellipsoid or full ellipsoidal microcavities) is defined, and one or both of the first and second thin layers and electrodes are arranged with respect to the microcavity to excite a plasma within said microcavities upon application of a predetermined voltage to the electrodes.

A method for forming a microcavity plasma device having a plurality of half or full ellipsoid microcavities in one or both of first and second thin layers is also provided by a preferred embodiment. The method includes defining a pattern of protective polymer on the first thin layer. Powder blasting forms half ellipsoid microcavities in the first and, if desired, second thin layers. The second thin layer is joined to the first layer. The patterning can be conducted lithographically or can be conduced with a simple screen.

Preferred embodiments will now be discussed with respect to the drawings. The drawings include schematic figures that are not to scale, which will be fully understood by skilled artisans with reference to the accompanying description. Features may be exaggerated for purposes of illustration. From the preferred embodiments, artisans will recognize broader aspects of the invention.

Figure 1A:
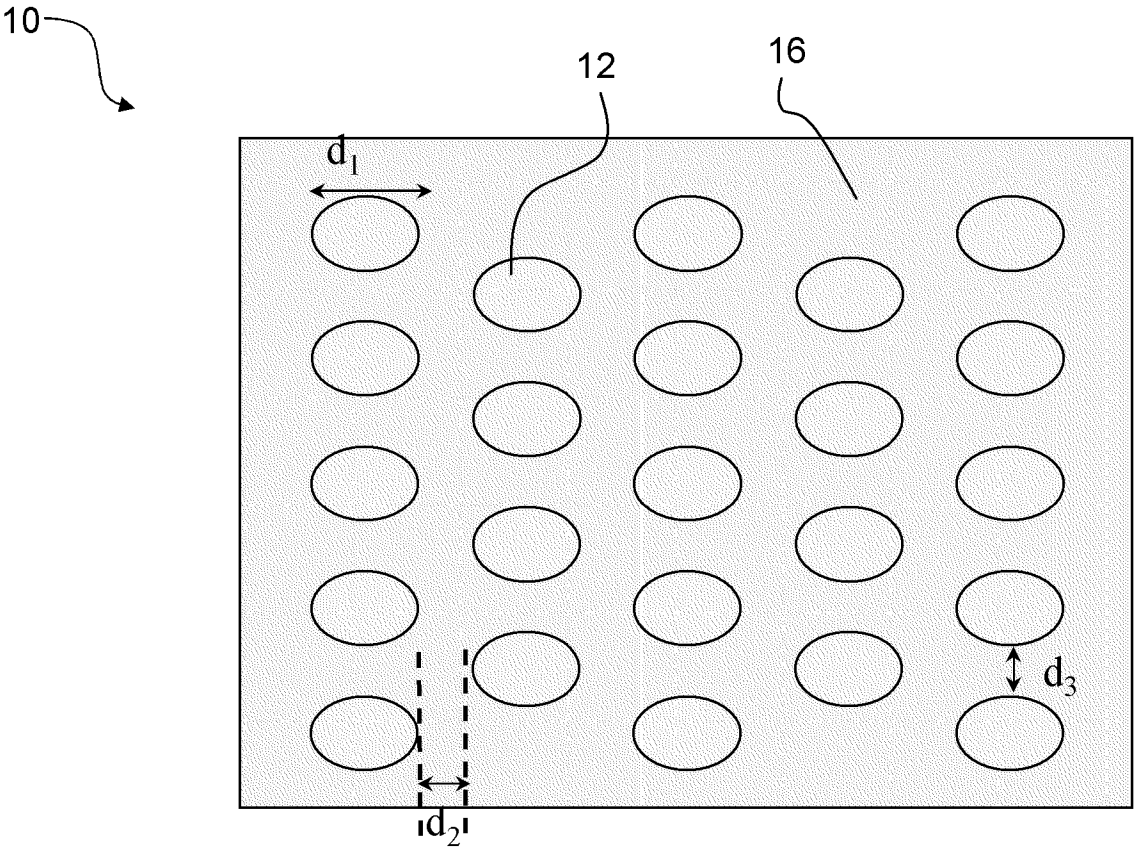
FIG. 1A is a schematic top view of an exemplary embodiment array of microcavity plasma devices of the invention.
Figure 1B:
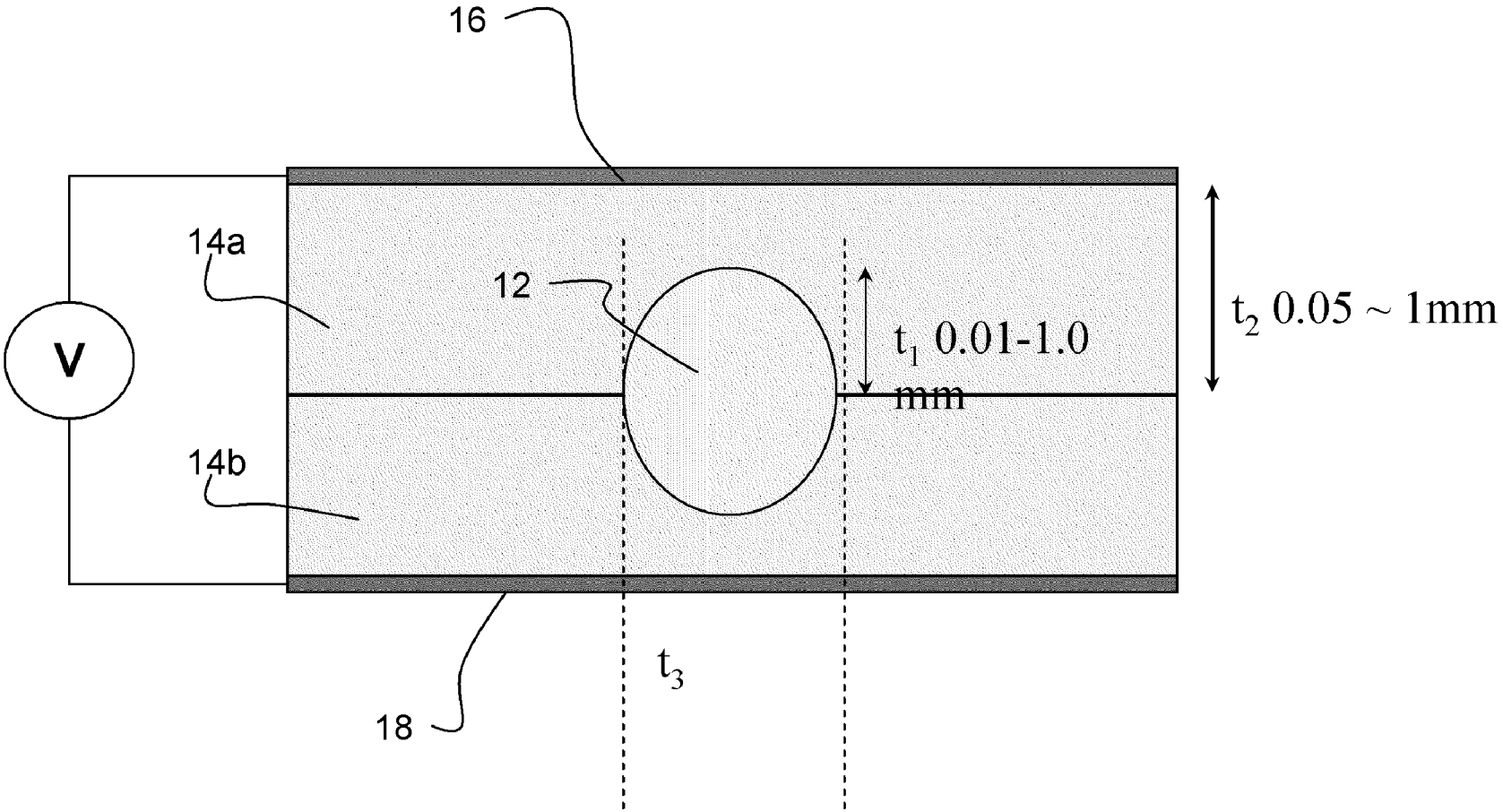
FIG. 1B is a schematic cross-section of a portion of one of the microcavity plasma devices of the array of FIG. 1A.

FIGS. 1A and 1B illustrate a preferred embodiment microcavity plasma device array 10 of the invention. Ellipsoidal microcavities 12 are defined in first and second thin layers 14*a* and 14*b*. In the FIGS. 1A and 1B embodiment, half of each of the microcavities 12 is defined in each of the first and second thin layers 14*a* and 14*b*, and the microcavities 12 are completed when the first and second thin layers are joined together in the presence of gas(es) and/or vapor(s) in which plasma will be generated. Cavities 12 are completed when the two sheets 14*a*, 14*b* are bonded together by a suitable technique. Example suitable bonding methods include anodic bonding, glass frit, or epoxy. The sheets 14*a*, 14*b* can also be heated so as to bond together without need for any separate bonding agent between the sheets. Electrodes 16, 18 are formed on the first and second layers 14*a*, 14*b*, and are isolated from plasma produced within the microcavities 12, thereby promoting the lifetime of the array 10, and electrically insulating the electrodes 16, 18. At least one of the conductors 16, 18 is transparent to emission wavelengths generated by the plasma, and both can be transparent to have dual-sided emission from the array 10. The electrodes 16, 18, such as ITO (indium tin oxide) are evaporated or otherwise deposited onto the exterior of the sheets 14*a*, 14*b*. The electrodes can be deposited onto the sheets either before or after the formation of microcavities and before or after the joining of the sheets together. When a time-varying voltage of the proper magnitude is applied to the top and bottom electrodes 16, 18 of the array, microplasmas are produced within the individual cavities 12. The time varying voltage may be sinusoidal, pulsed, or have another function form (ramp, triangular, etc.).

The sheets 14*a* and 14*b* can be very thin, the thickness being limited only by the ability to handle large sheets during manufacturing. In example prototype glass arrays produced in the laboratory, the thickness $t_2$ of each glass sheet was nominally 600 μm to 1 mm. It is expected that glass sheets at least as thin as 300 μm will also be acceptable. Typical major diameters (height or vertical dimension) ($2\times t_1$) of the egg-shaped microcavities 12 were 100 μm to 1 mm in the laboratory experiments. Typical minor diameters $t_3$ (width or horizontal dimension) of the central region of the microcavities 12, which is the characteristic dimension of the microcavities, were in the range of 10-500 μm. The dimensions labeled $d_1$, $d_2$, and $d_3$ represent, respectively, the transverse width of an ellipsoidal cavity 12, and the horizontal and vertical spacing between adjacent rows and columns of cavities 12 in the array 10.

Figures 2A, 2B, 2C:
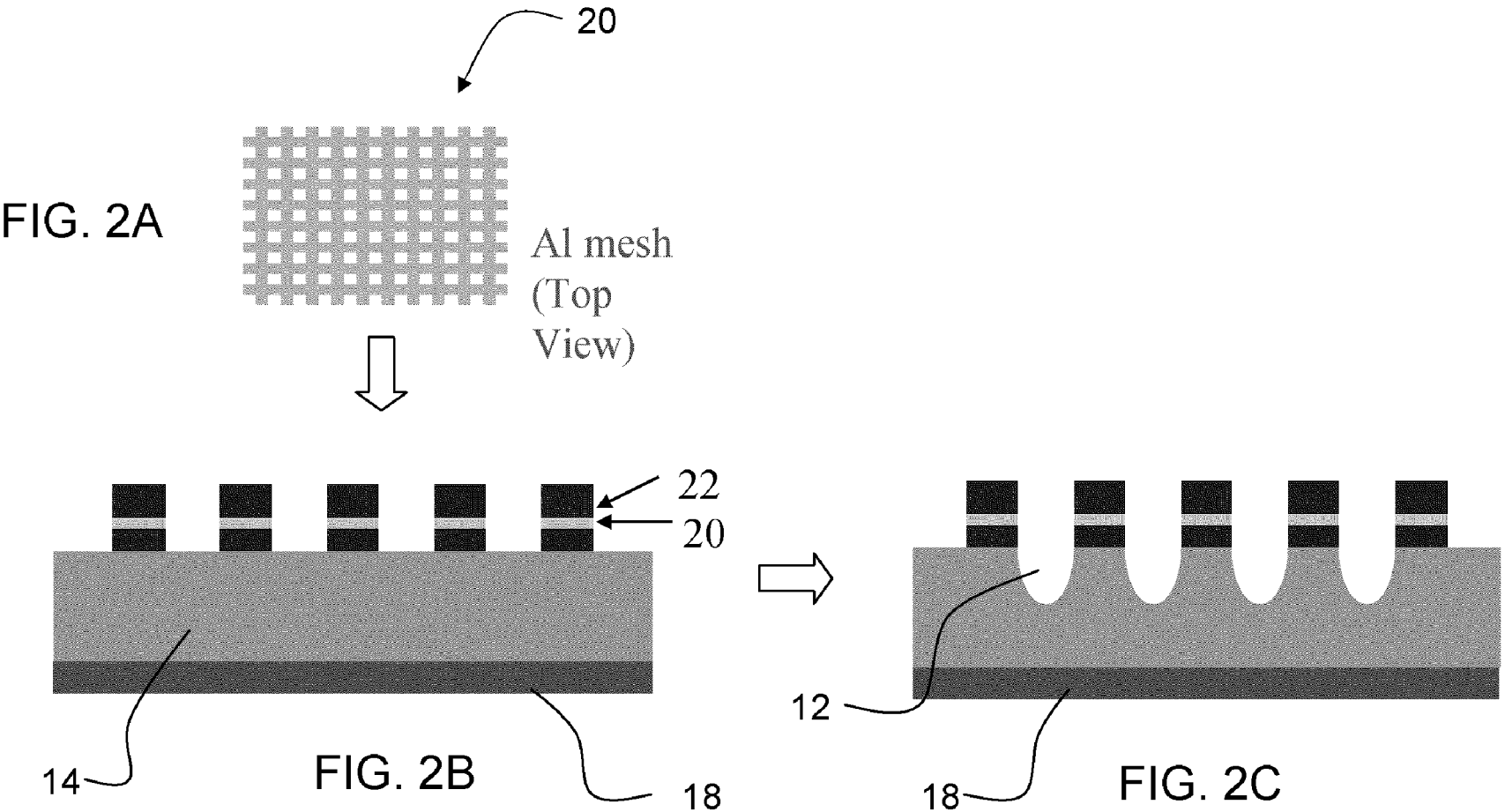
FIGS. 2A-2C illustrate a preferred embodiment method for fabricating an array of microcavity plasma devices of the invention.

FIGS. 2A-2D illustrate an example embodiment method for fabricating a microcavity plasma device array of the invention. FIG. 2A illustrates an Al wire mesh (fabric) 20, having openings of the desired dimension (central diameter) of the microcavities 12, that is used as a mask to protect a glass layer 14. Powder blasting is an intensely erosive process, and the inventors have discovered a method to protect the mesh 20. In a preferred embodiment, the mesh 20 is covered with an ultraviolet (UV) curable ink 22 that has been found to be resistant to the micro blasting process. The ink 22 is preferably a polymer having relatively low viscosity. The ink is painted all around the wire mesh 20 so that it protects the mesh 20 from the blasting. Nanopowder blasting produces microcavities 12, as seen in FIG. 2C, and the protective layer (wire mesh 20 plus ink 22) is removed following Step 2C. The surface profile of the microcavities 12 is determined by the size of the powder particles used in the powder blasting process. Example powders include those made of $Al_2O_3$, $SiO_2$, SiC or metal carbonates. The size of particles in these powders is between about 500 nm and 30 μm.

The steps discussed above are repeated to produce an identical microcavity array pattern in another glass substrate, and the two glass substrates are joined as the cavities are filled with the desired gas or vapor and sealed to produce the array 10. In another variation, the second glass sheet 14*a* does not have any microcavities, but is a plain glass sheet with the electrode 16. The microcavities in such a case possess a "half-egg" shape, but can also support plasma generation. Indeed, experiments with "half-ellipsoidal" microcavity plasma devices show them to produce an intense glow that is more spatially localized (around the axis transverse to the glass sheets) than is the case with full ellipsoids.

Figure 3A:
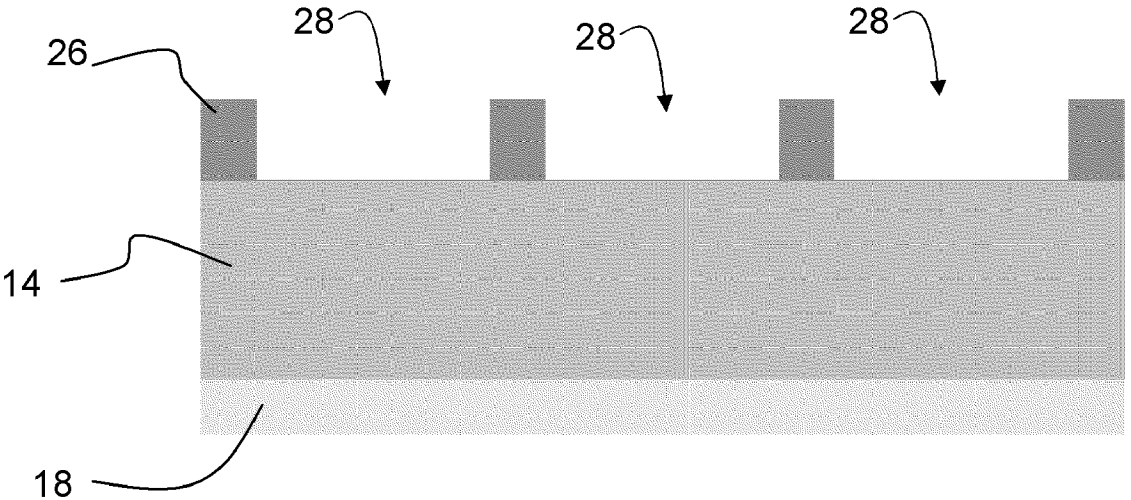
FIG. 3A-3E illustrate another preferred embodiment method for fabricating an array of microcavity plasma devices of the invention.
Figure 3B:
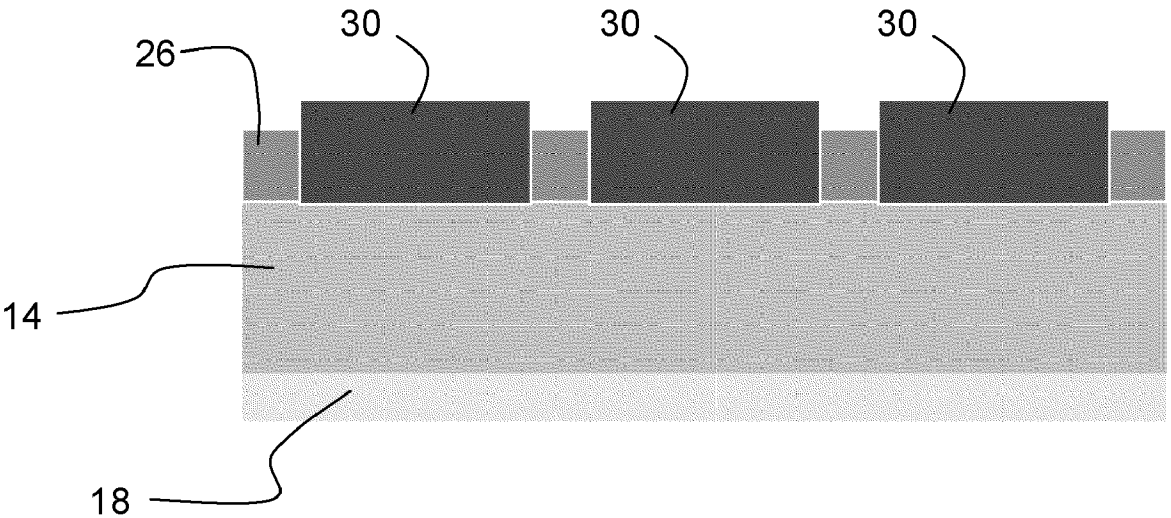
Figure 3C:
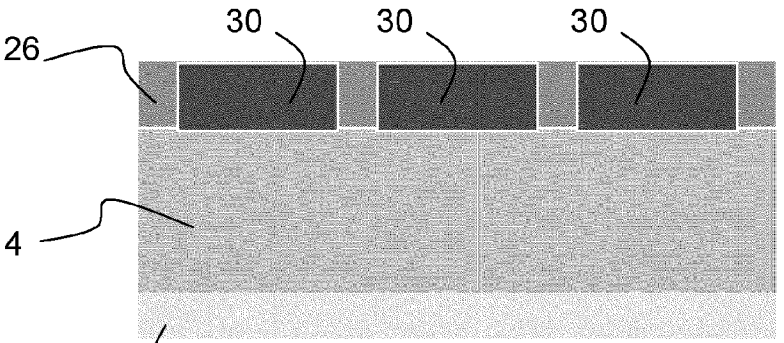
Figure 3D:
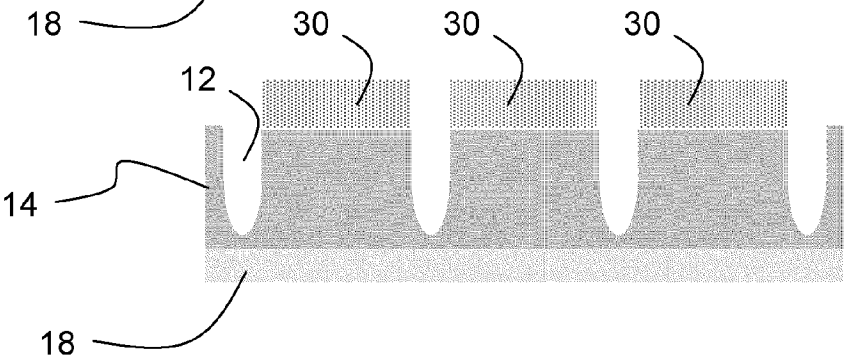
Figure 3E:
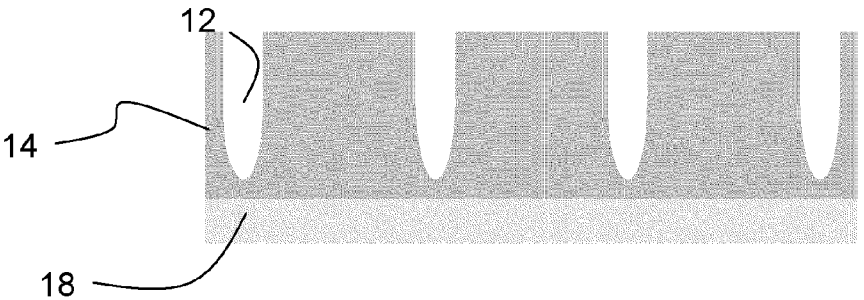

Higher resolution and more precise spacing are offered by a preferred embodiment fabrication process that is illustrated in FIGS. 3A-3E. The process begins as in FIG. 2A, with a glass sheet 14 having an electrode 18 on one side. As mentioned above, the electrodes can also be formed at any other time in the fabrication process, including after the joining of the two glass sheets together. In FIG. 3A, photoresist 26 has been patterned onto the glass sheet 14 by conventional deposition, development, and chemical etching steps. The photoresist pattern is defined such that the photoresist represents the areas in which powder blasting will occur and openings 28 between the photoresist are areas which will be protected during the powder blasting process. In FIG. 3B, the openings 28 are filled with a UV curable protective polymer 30 that is strongly resistant to the nanopowder blasting process. It is advantageous to use UV curable polymers that are soft (having high tension). In FIG. 3C, the polymer 30 and photoresist 26 are planarized, and in FIG. 3D the polymer 30 is first UV cured. Powder blasting then removes the photoresist easily and proceeds to etch the microcavities 12 in the glass sheet 14. The photoresist 26 is easily removed by the micro blasting process so that, when the blasting step begins, etching of the glass surface takes place only at those locations where the photoresist exists. In FIG. 3E, the polymer is removed, leaving an array of microcavities in the glass sheet 14. The process of FIGS. 3A-3E permits the pattern of the array and the dimensions of individual microcavities to be specified photolithographically.

Fabrication methods of the invention enable reproducible tailoring of the microcavity cross-sectional geometry for the purpose of achieving a desired electric field profile within the cavity. As an example, prolonging the powder blasting produces a pronounced tapering of the half-cavity being formed. This has been demonstrated experimentally, and such tapering has the effect of accentuating the electric field in this region when the two half-cavities are bonded together and a voltage is applied to the electrodes. In an experimental example, cavities with a pronounced taper were produced with an electric field that is much weaker along the vertical axis (major diameter) of the cavity than near the walls of the microcavity at its central region near the minor diameter (walls intersected by the minor diameter. If the powder blasting step is intentionally shortened in time, the cavity sidewalls will be nearly vertical at the mid-plane of the cavity, resulting in an electric field profile that is much more spatially uniform.

The aspect ratio of blasted microcavities is also dependent on the pressure of the blasting process, the type of powder material used in the blasting, and the type of masking materials used in the fabrication. Typical values of the aspect ratio (depth to width) of the microcavity can be range between 1:1 and 3:1. Such aspect ratios can be achieved with a pressure of about 30 psi to 120 psi.

Figure 3G:
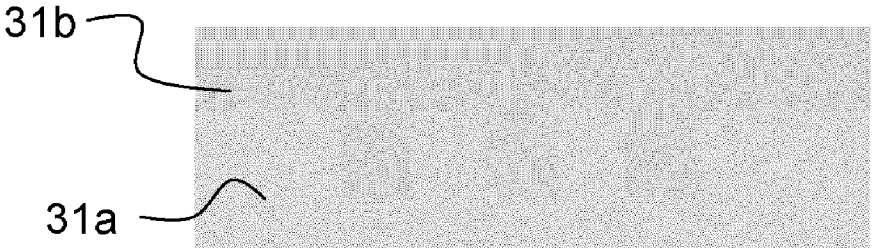
FIGS. 3F-3J illustrate a modified mask fabrication process that can be used to fabricate the mask in the FIG. 2A-2C or FIG. 3A-3E method for fabrication of an array of microcavity plasma devices of the invention.
Figure 3I:
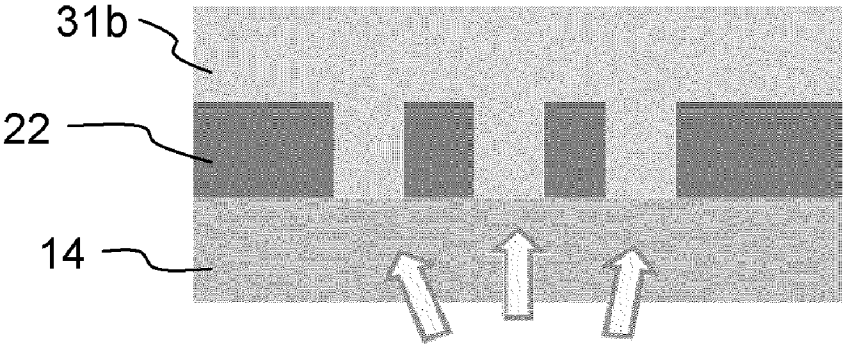
Figure 3F:
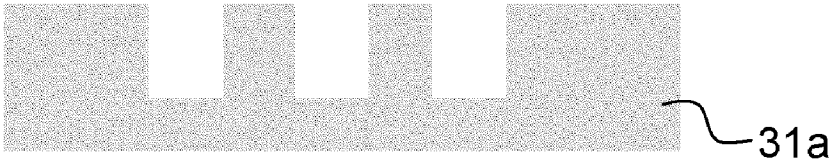
Figure 3H:
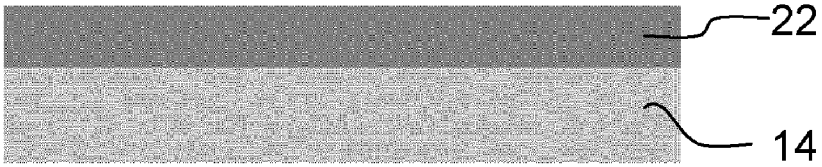
Figure 3J:
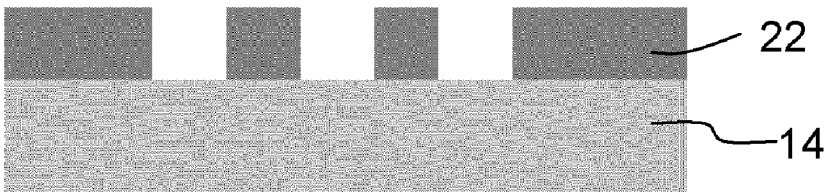

FIGS. 3F-3J illustrate a modified mask fabrication process that can achieve higher aspect ratio microcavities and higher resolution spacing between microcavities. In FIG. 3F, a high resolution pattern is transferred from a lithography design onto semiconductor wafer 31*a*, such as a Si wafer, by a suitable etching method, e.g., ICP DRIE etching or wet chemical etching. In FIG. 3G, PDMS (polydimethylsiloxane) resin 31*b* is applied onto the patterned Si water 31*a* and cured. This creates a PDMS stamp having a negative version of the pattern obtained by the wafer processing in FIG. 3F. In FIG. 3H, a glass, ceramic or polymer substrate 14 is spin coated with UV ink 22, which is left uncured. The PDMS stamp 31*a* obtained in FIG. 3G (after separation from the wafer 31*a*) is pressed onto the UV curable ink in FIG. 3I and the UV ink 22 is cured by UV radiation while the PDMS stamp is present. In FIG. 3J, the PDMS stamp 31*b* is removed and the powder blasting process of FIG. 2C and FIG. 3D can be conducted to form half ellipsoid microcavities.

Additional embodiment microcavity plasma device arrays are realized with alternative electrode placements and patterns and other variations. In illustrating the additional embodiments, the reference numbers from FIGS. 1-3 will be used to identify similar features.

Figure 4:
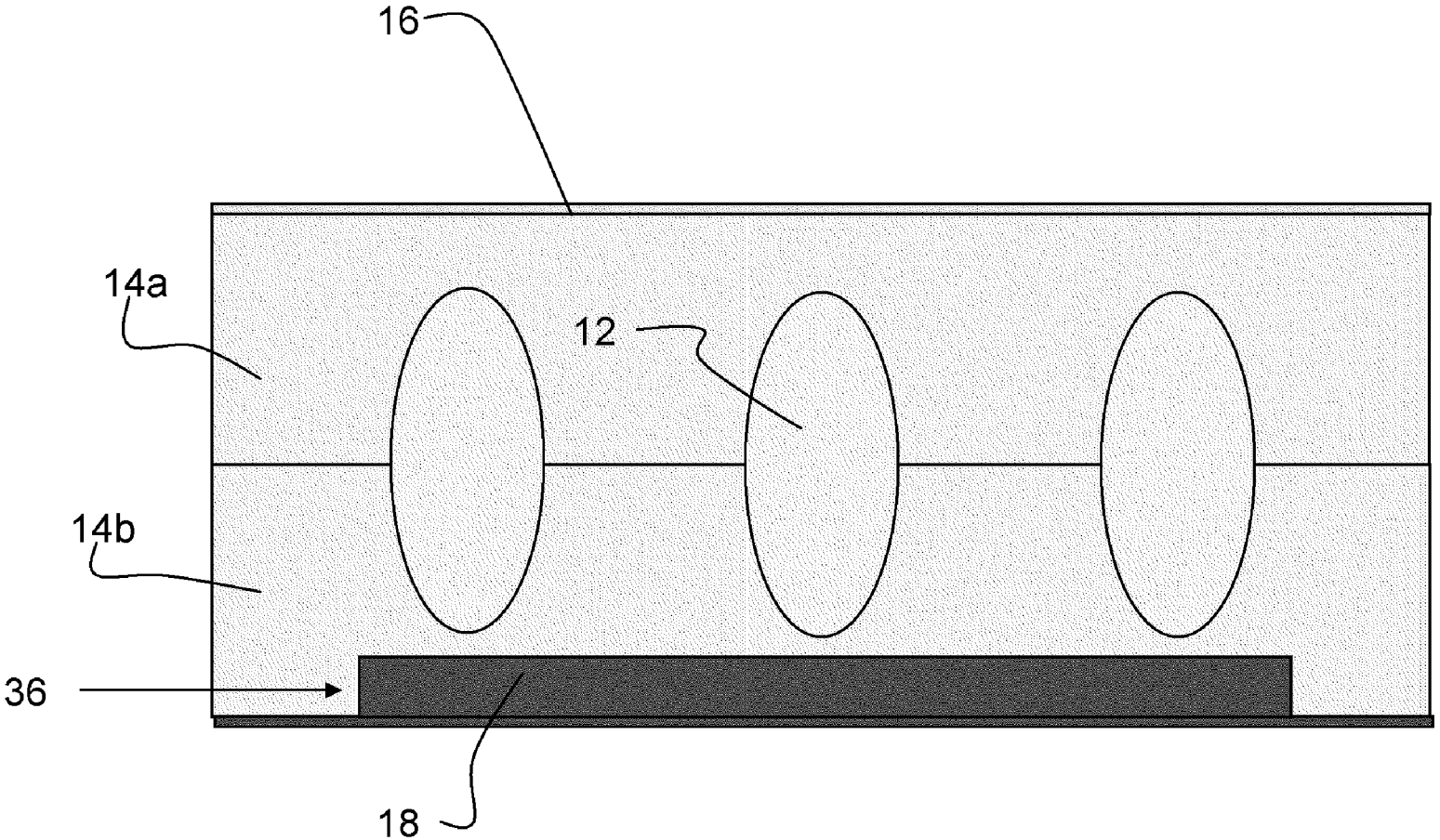
FIG. 4 is a schematic cross-section of a portion of another microcavity plasma device array of the invention.
Figure 5:
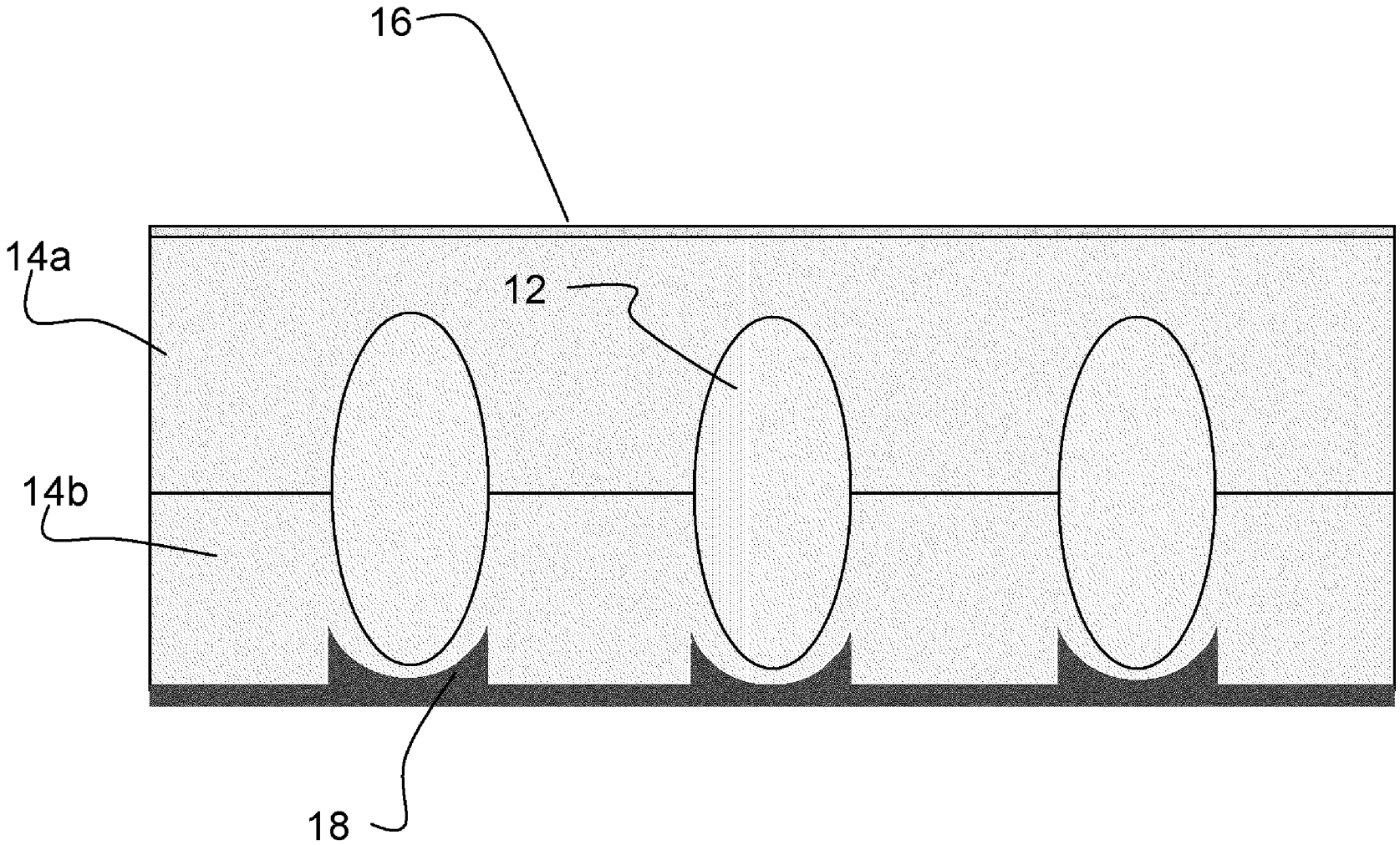
FIG. 5 is a schematic cross-section of a portion of another microcavity plasma device array of the invention.

In FIG. 4, the electrode 18 is formed in a recess 36 on the back side of the sheet 14*b*. While not shown in FIG. 4, the electrode 16 could also be formed in a similar recess. The recess 36 serves to reduce the electrode-microcavity gap. FIG. 5 shows a similar arrangement, but in FIG. 5 the recess is shaped to have a contour that mimics the shape of the microcavities 12. The FIG. 5 arrangement also reduces the electrode-microcavity gap, and the contour of the electrode 18 near the microcavities 12 changes the electric field applied by the electrode 18 so as to be more uniform within the lower portion of the ellipsoidal microcavity than is the case with the electrode structure of FIG. 4. The reason for the difference is that, in FIG. 5 the thickness of the glass separating the electrode 18 at the base of the ellipsoid from the microcavity 12 is approximately constant. In contrast, in FIG. 4 the glass thickness between the electrode and the microcavity wall changes along the base of the microcavity, thereby adversely impacting discharge uniformity.

Figure 6:
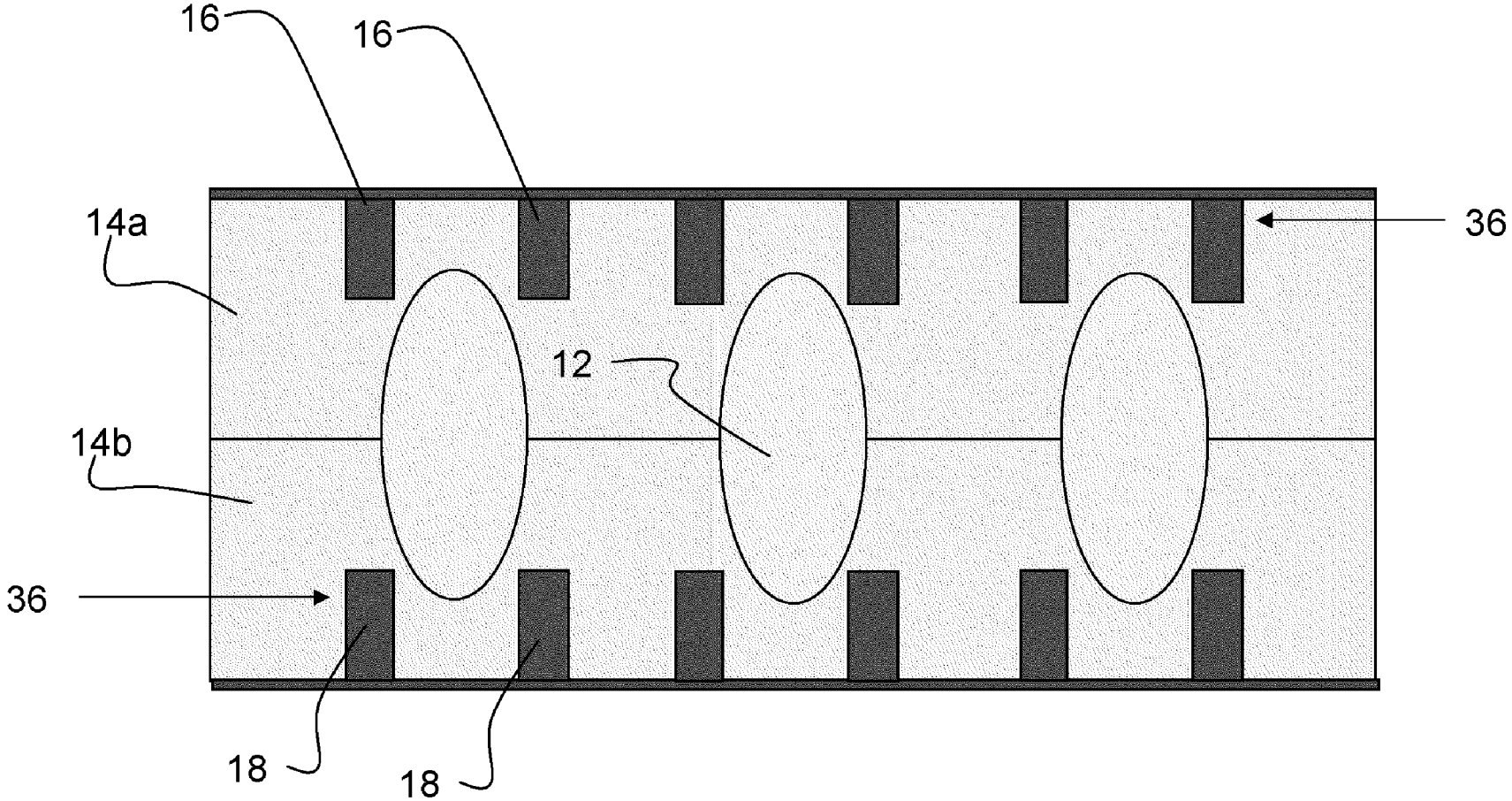
FIG. 6 is a schematic cross-section of a portion of another microcavity plasma device array of the invention.

FIG. 6 shows a microcavity plasma device array that also brings the electrodes 16 and 18 close to the microcavities. In FIG. 6, a plurality of cavities 36 are vertically etched in the glass layers 14*a* and 14*b*. This places the electrodes 16, 18 near the microcavities in a finger-like fashion on two sides of the cavities. The trenches 36 in both FIGS. 5 and 6 can be fabricated by etching or powder blasting techniques and coated (or lined) with metal or other conducting material.

Figure 7:
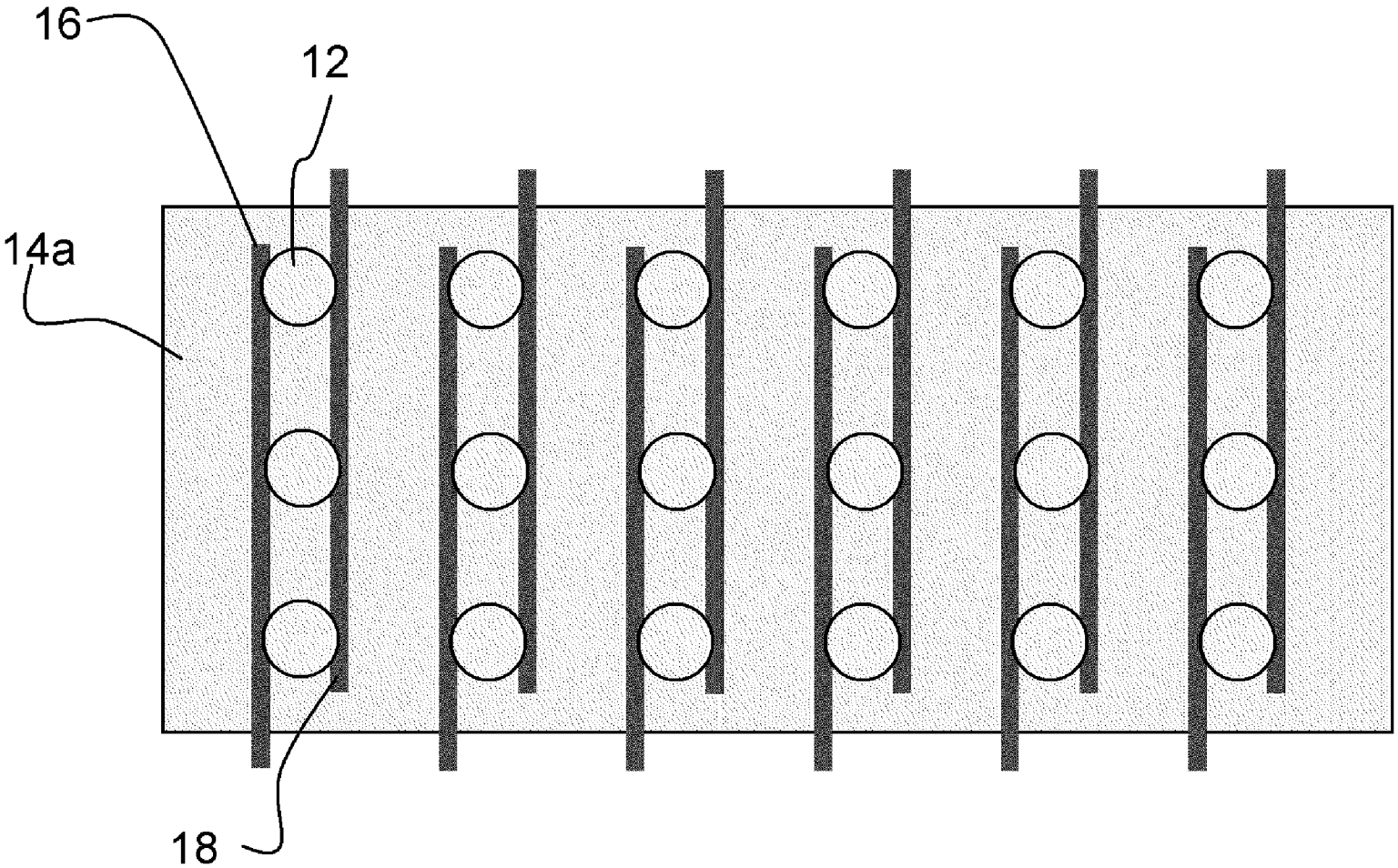
FIG. 7 is a schematic top view of another microcavity plasma device array of the invention.

The embodiments illustrated in FIGS. 1-6 can be made to be addressable by patterning one or both of the electrodes 16, 18. An example of an addressable microcavity plasma device array is illustrated in FIG. 7. In FIG. 7, electrodes 16, 18 are arranged to straddle the microcavities 12, which provides for the addressing of individual cavities or rows of cavities by a passive matrix approach.

Figure 8:
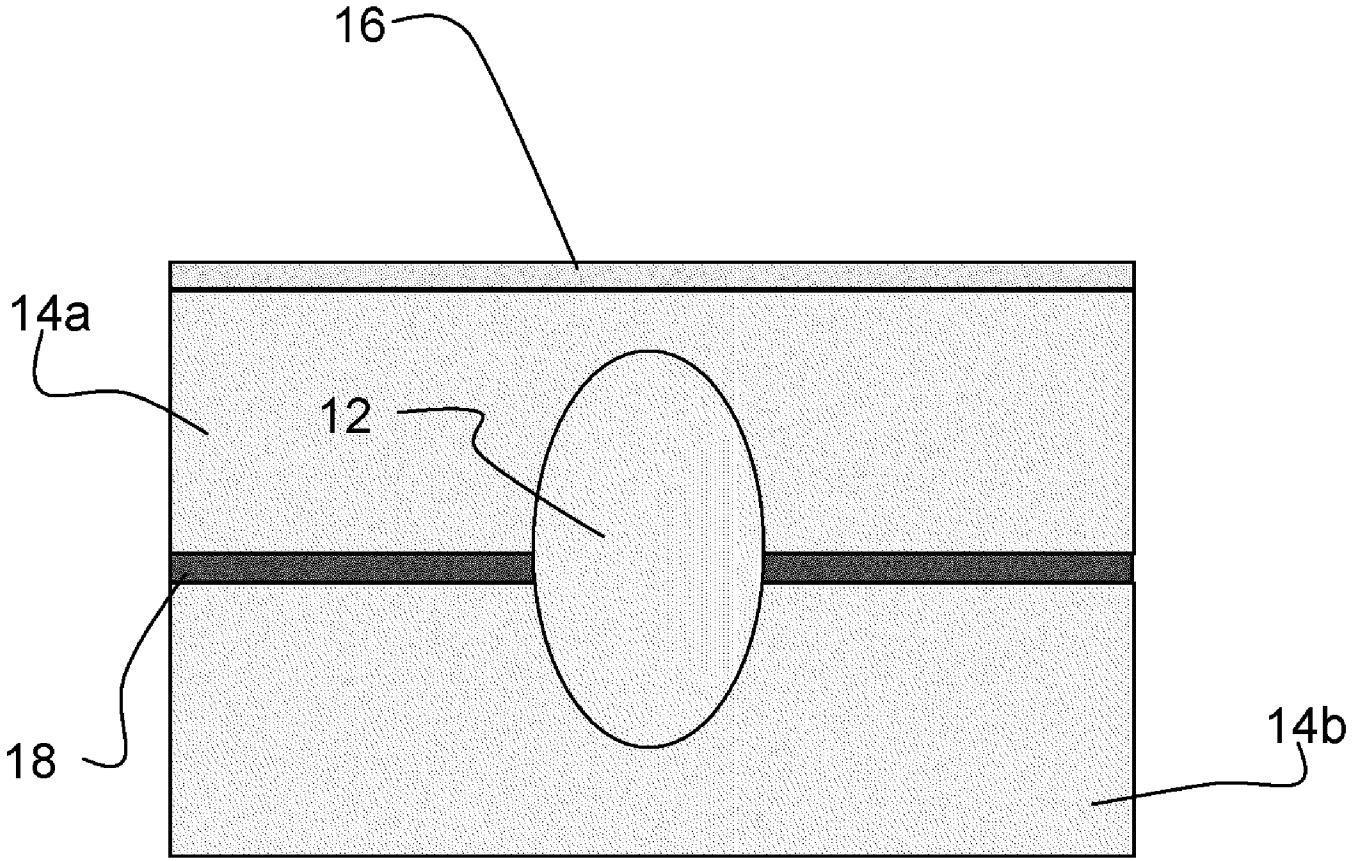
FIG. 8 is a schematic cross-section of another microcavity plasma device of the invention.
Figure 9:
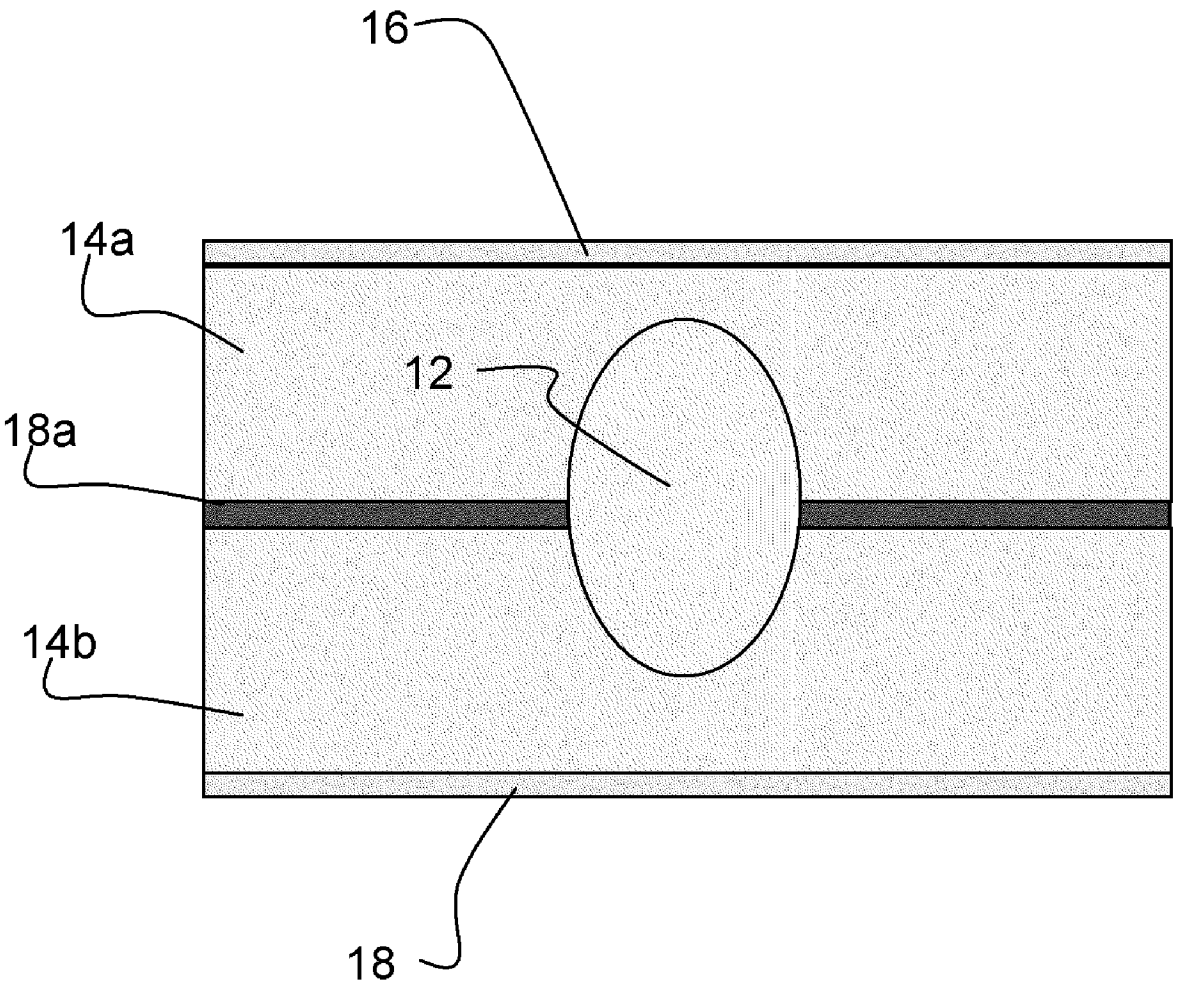
FIG. 9 is a schematic cross-section of another microcavity plasma device of the invention.
Figure 10:
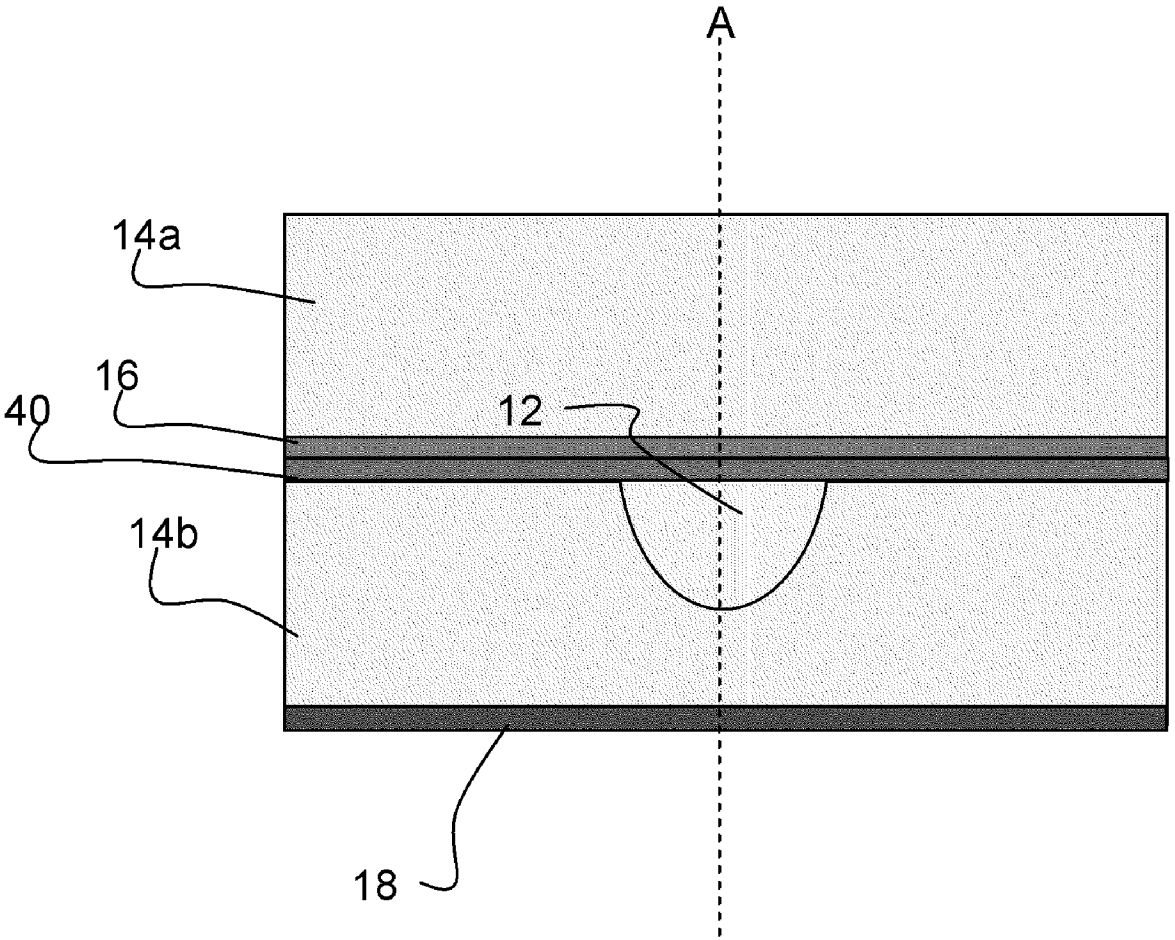
FIG. 10 is a schematic cross-section of a half ellipsoid plasma device of the invention.

FIG. 8 shows another electrode arrangement for a microcavity plasma device and array of the invention. In FIG. 8, the electrode 18 is disposed between the glass sheets 14*a* and 14*b* and surrounds the microcavity 12. The electrode 18 can be patterned on either of the glass sheets 14*a* and 14*b* before they are joined together. FIG. 9 shows an arrangement with an additional central electrode 18*a* which can be used as a trigger electrode to ignite a plasma in each microcavity. FIG. 10 shows an arrangement where the electrode 16 is a central electrode and is isolated from a half-egg shaped microcavity 12 by a thin dielectric layer 40. As noted earlier, half-ellipsoid cavities have, in laboratory tests, exhibited intense plasmas localized around an axis passing vertically through the center of the half-ellipsoid (axis "A" in FIG. 10). Furthermore, because the half-ellipsoid cavity is capped with flat films and a flat glass layer, the light emanating from the plasma is not distorted by the lens-like nature of full-ellipsoid cavities of FIGS. 1B, 4-6, 8, and 9. Therefore, the half- and full-ellipsoid cavities will each be advantageous in different applications.

Central electrode microcavity plasma devices of the invention fabricated in glass provide additional options for tailoring the electric field. Experimental devices in accordance with the FIG. 10 half ellipsoid shaped cavity produce intense plasmas that are strongly localized near the vertical axis of the cavity. In the FIG. 10 half ellipsoid embodiment, the top glass layer 14*a* can be particularly thin since the top glass layer 14*a* acts only as a packaging layer and does not have any portion of the microcavities existing within the layer. With the half ellipsoid arrangement, the overall thickness of a glass microcavity plasma device array can be very small, e.g., 100-200 μm or less. Generally, the central electrode devices that have a central electrode disposed in a plane intersecting the microcavities 12 have lower ignition voltages than devices and arrays only having electrodes disposed in planes that are adjacent to the microcavities.

Figure 11:
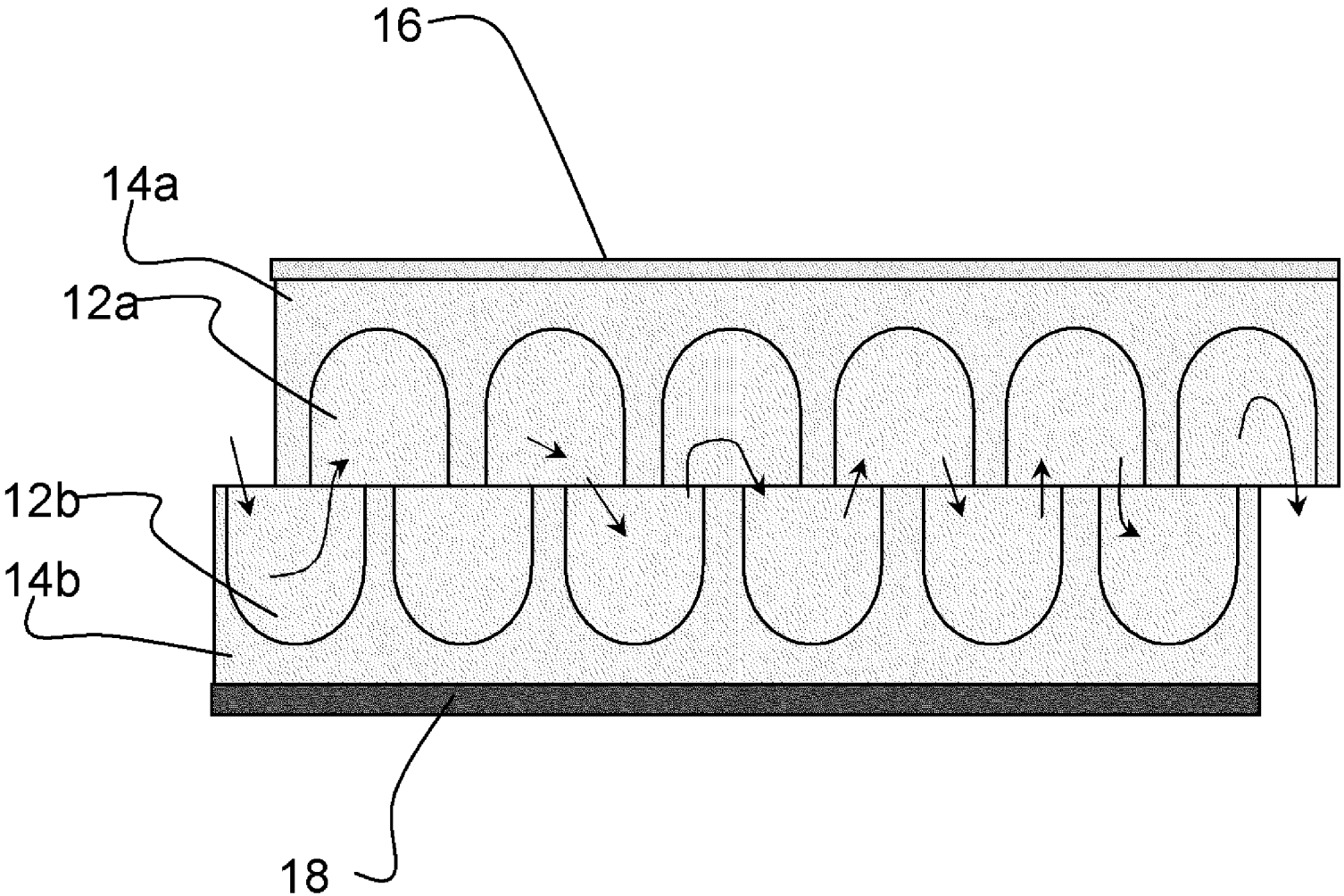
FIG. 11 is a schematic cross-section of another microcavity plasma device array of the invention.
Figure 12A:
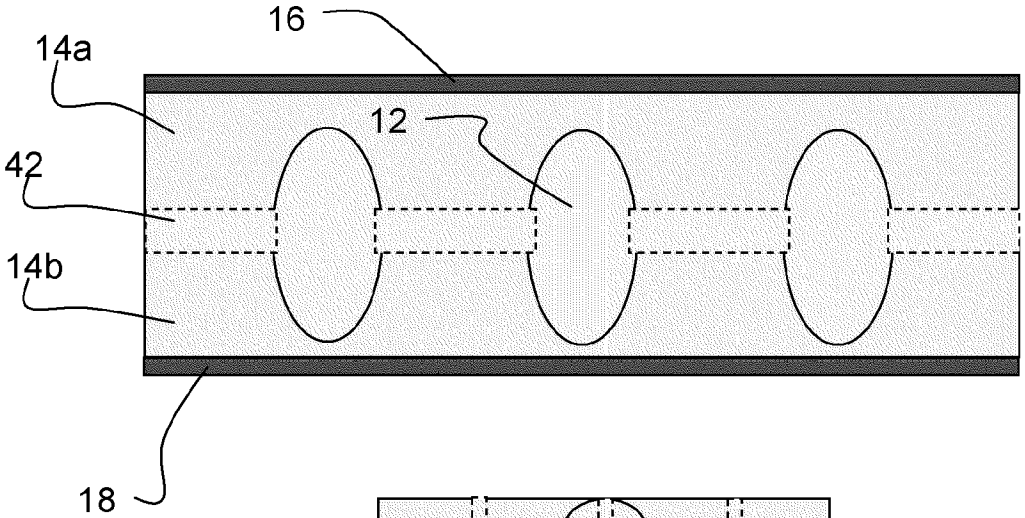
FIGS. 12A and 12B are schematic cross-section and top views, respectively, of a another microcavity plasma device array of the invention.
Figure 12B:
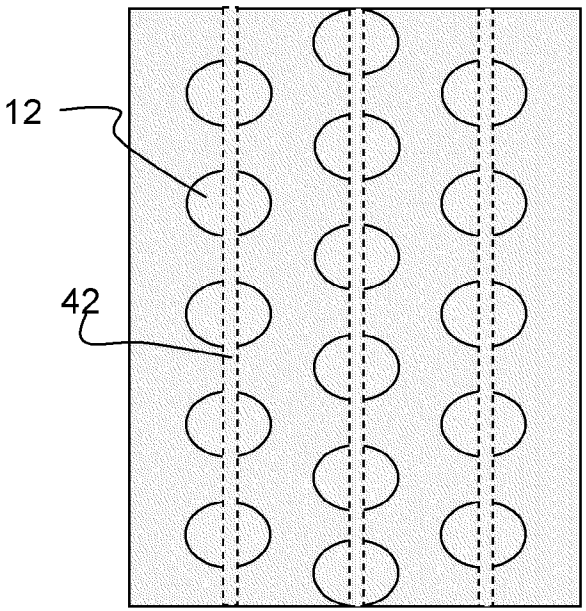

FIG. 11 shows another preferred embodiment glass microcavity plasma device array. In the FIG. 11 array, the glass sheets 14*a* and 14*b* are offset when they are joined together to create a slight offset between upper and lower microcavity halves 12*a* and 12*b*. The FIG. 11 array permits the array to be filled with gas(es) or vapors(s) and/or for gas/vapor flow among the microcavities after the two glass sheets are joined. Another array shown in FIGS. 12A and 12B also permits such gas/vapor flow, in this case provided by flow channels 42 at the mid-plane of the microcavities 12 which allow for gas flow between the cavities 12. Flow channels 42 can be formed in the glass sheets 14*a* and 14*b* at the same time as the microcavities according to the method of FIG. 3 by defining an appropriate photoresist and protective polymer pattern prior to powder blasting.

Figure 13:
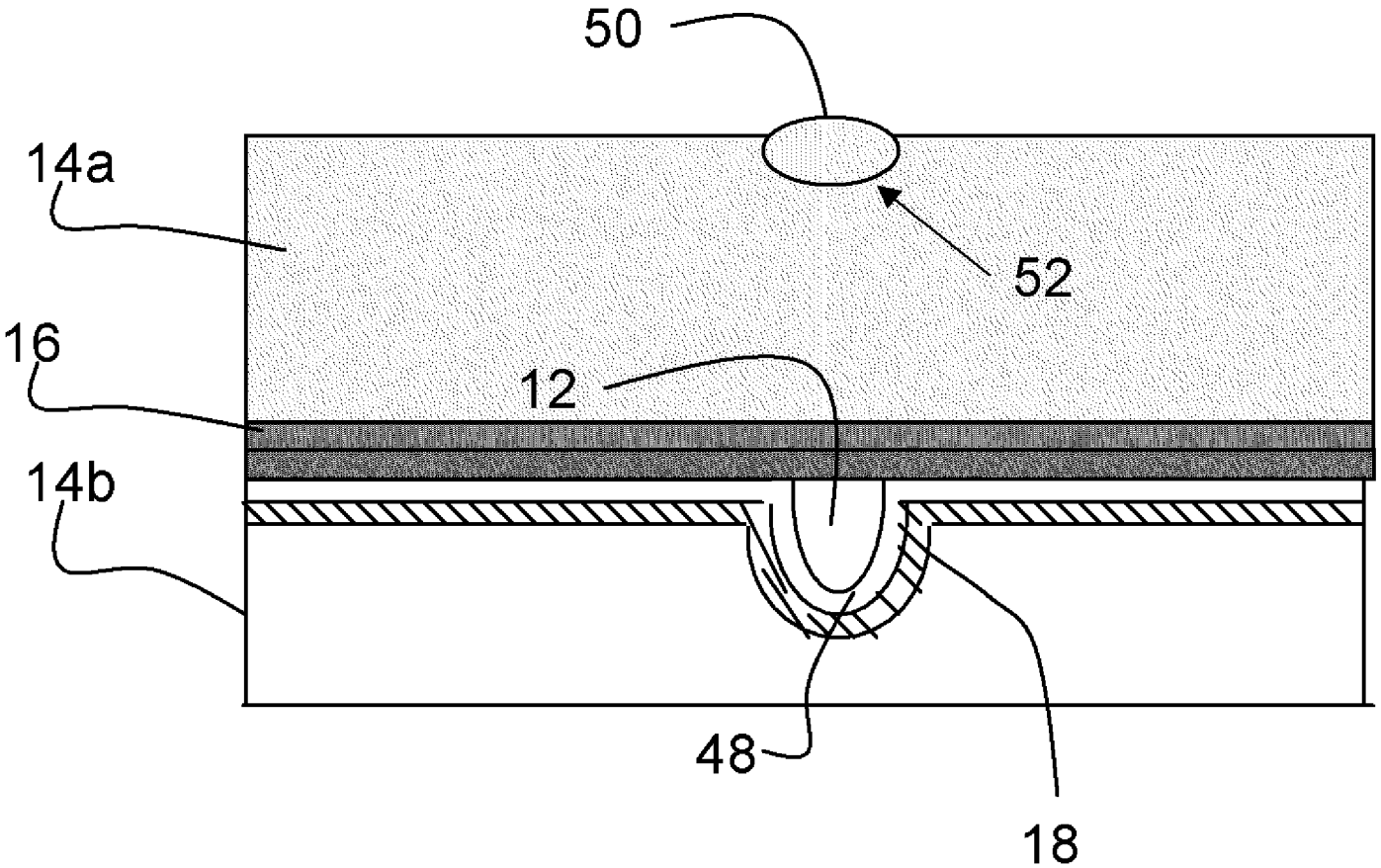
FIG. 13 is a schematic cross-section of another microcavity plasma device of the invention.

In a variation of the FIG. 10 device (or of other devices of the invention), the electrode 18 is deposited on the internal wall of the half-egg microcavity 12, and protected and isolated from plasma by an additional dielectric layer 48, as shown in FIG. 13. The dielectric layer 48 can be omitted to permit DC operation, but use of a dielectric layer 48 is strongly preferred to isolate the electrodes from plasma generated in the microcavities. As seen in FIG. 13, phosphor 50 can be deposited into shallow depressions 52 registered above the microcavities 12. The quasi-spherical depressions 52 can also be etched chemically or powder blasted. These depressions can serve as a lens to collimate the radiation emerging from the microcavity 12 and simultaneously keep the phosphor below the plane of the surface for protective purposes. Screen printing can also be used to print circular dots of phosphor on the glass layers 14*a*, 14*b* directly aligned with a particular microcavity. If preferred, phosphors 50 can be coated within the microcavities 12 to achieve a desired color of emission. Red, green, and blue phosphors will be alternated for full RGB (color) capability.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

The invention claimed is:

1. A microcavity plasma device, comprising:

first and second thin layers joined together;

a half ellipsoid microcavity defined in one of said first and second thin layers containing a plasma medium in the microcavity;

electrodes arranged with respect to said microcavity to excite a plasma confined within and by said microcavity upon application of a predetermined time-varying voltage to said electrodes, wherein said electrodes are isolated from plasma generated within said microcavity; and a plasma medium consisting of vapor(s) and/or gas(es) within said microcavity.

2. The device of claim 1, wherein said electrodes comprise transparent electrodes.

3. The device of claim 1, wherein each of said first and second layers has a half ellipsoid microcavity.

4. The device of claim 3, wherein half ellipsoid microcavities of the first and second layers are aligned to form full ellipsoid microcavities.

5. The device of claim 3, comprising a plurality of half ellipsoid microcavities in said first and second layers that are joined to form an array of full ellipsoid microcavities.

6. The device of claim 5, wherein at least one of said electrodes is disposed on a surface of one of said first and second layers.

7. The device of claim 5, wherein at least one of said electrodes is disposed in a trench formed in one of said first and second layers.

8. The device of claim 5, wherein at least one of said electrodes is disposed between said first and second layers.

9. The device of claim 8, further comprising a dielectric layer that isolates said at least one of said electrodes from plasma generated in said microcavities.

10. The device of claim 8, wherein at least one of said electrodes is disposed within said microcavities and is isolated from plasma generated in said microcavity by a dielectric layer.

11. The device of claim 5, wherein at least one of said first and second electrodes comprises a plurality of addressing electrodes to address individual ones of said microcavities.

12. The device of claim 5, wherein half ellipsoid microcavities of said first and second layers are aligned.

13. The device of claim 5, further comprising a channel defined in at least one of said first and second layers, said channel connecting a plurality of said microcavities.

14. The device of claim 5, further comprising phosphor carried by at least one of said first and second layers and aligned with at least one of said microcavities.

15. The device of claim 14, wherein said phosphor is carried in a depression formed in said at least one of said first and second layers.

16. The device of claim 3, comprising a plurality of half ellipsoid microcavities in said first and second layers that are joined to form an array, wherein half ellipsoid microcavities of said first and second layers are slightly offset.

17. The device of claim 1, wherein at least one of said electrodes is contoured to match the shape of a portion of said microcavity.

18. The device of claim 1, wherein said first and second layers comprise glass layers.

19. The device of claim 1, wherein said first and second layers comprise ceramic layers.

20. The device of claim 1, wherein said first and second layers comprise polymer layers.

21. The device of claim 1, wherein the other of said first and second thin layers is flat and seals the plasma medium in said microcavity.

22. The device of claim 1, wherein said first and second layers seal the plasma medium into said microcavity.

23. The device of claim 22, wherein said first and second layers seal the plasma without any additional packaging layers.

24. The device of claim 23, wherein said first and second layers comprise glass and the overall thickness of the device is less than 200 μm.

25. The device of claim 23, wherein said first and second layers comprise glass and the overall thickness of the device is less than 200 μm.

26. The device of claim 1, wherein said microcavity has a major diameter and a minor diameter.

27. A microcavity plasma device, substantially consisting of:

first and second thin layers joined together;

a plurality of half or full ellipsoid microcavities defined by one or both of said first and second thin layers containing and confining a plasma medium in the microcavities;

electrodes arranged with respect to said microcavities to excite a plasma within said microcavities upon application of a predetermined time-varying voltage to said electrodes wherein said electrodes are isolated from plasma generated within said microcavity; and a plasma medium consisting of vapor(s) and/or gas(es) within said microcavity.

28. The device of claim 27, wherein said first and second layers comprise glass layers.

29. The device of claim 27, wherein said first and second layers comprise ceramic layers.

30. The device of claim 27, wherein said first and second layers comprise polymer layers.

31. The device of claim 27, wherein one of said first and second thin layers is flat and seals the plasma medium microcavities of the other layer.

32. The device of claim 27, wherein said first and second layers seal the plasma without any additional packaging layers.

33. A method for forming a microcavity plasma device having a plurality of half or full ellipsoid microcavities in one or both of first and second thin layers, the method comprising steps of:

defining a pattern of protective polymer on the first thin layer;

powder blasting the first thin layer to form half ellipsoid microcavities in the first thin layer; and joining the second thin layer to the first layer.

34. The method of claim 33, further comprising a step of forming electrodes on one or both of the first and second thin layers.

35. The method of claim 33, wherein said step of joining is conducted in the presence of a plasma medium.

36. The method of claim 33, wherein said first and second layers comprise glass layers.

37. The method of claim 33, wherein said first and second layers comprise ceramic layers.

38. The method of claim 33, wherein said first and second layers comprise polymer layers.

39. A method for forming a microcavity plasma device having a plurality of half or full ellipsoid microcavities in one or both of first and second thin layers, the method comprising steps of:

defining a pattern of protective polymer on the first thin layer;

powder blasting the first thin layer to form half ellipsoid microcavities in the first thin layer; and joining the second thin layer to the first layer, wherein said step of defining a pattern comprises:

providing a screen; and coating and bonding the screen to the first thin layer with a protective polymer.

40. A method for forming a microcavity plasma device having a plurality of half or full ellipsoid microcavities in one or both of first and second thin layers, the method comprising steps of:

defining a pattern of protective polymer on the first thin layer;

powder blasting the first thin layer to form half ellipsoid microcavities in the first thin layer; and joining the second thin layer to the first layer, wherein said step of defining a pattern comprises:

forming photoresist in the pattern; and depositing protective polymer in openings between the photoresist.

41. A method for forming a microcavity plasma device having a plurality of half or full ellipsoid microcavities in one or both of first and second thin layers, the method comprising steps of:

defining a pattern of protective polymer on the first thin layer;

powder blasting the first thin layer to form half ellipsoid microcavities in the first thin layer; and joining the second thin layer to the first layer, wherein said step of defining a pattern comprises:

etching a high resolution pattern into a semiconductor wafer;

depositing PDMS on the wafer and into the pattern to form a PDMS stamp;

separating the PDMS stamp from the wafer;

coating the first thin layer with UV curable ink;

pressing the PDMS stamp into the UV curable ink;

curing the UV curable ink; and removing the PDMS stamp.

* * * * *

UNITED STATES PATENT AND TRADEMARK OFFICE

CERTIFICATE OF CORRECTION

PATENT NO. : 8,179,032 B2
APPLICATION NO. : 12/235796
DATED : May 15, 2012
INVENTOR(S) : Eden et al.

It is certified that error appears in the above-identified patent and that said Letters Patent is hereby corrected as shown below:

| | |
|---|---|
| Col. 2, line 43 | Please delete “fill” and insert --full-- therefor. |
| Col. 3, line 65 | Please delete “conduced” and insert --conducted-- therefor. |
| Col. 5, line 60 | Please insert a --)-- after “diameter”. |
| Col. 6, line 1 | After “can” please delete “be”. |

Signed and Sealed this
Eleventh Day of December, 2012

David J. Kappos

David J. Kappos
*Director of the United States Patent and Trademark Office*